US008231702B2

(12) United States Patent
Bergman et al.

(10) Patent No.: US 8,231,702 B2
(45) **Date of Patent: *Jul. 31, 2012**

(54) METALLURGICAL POWDER COMPOSITION AND METHOD OF PRODUCTION

(75) Inventors: Ola Bergman, Helsingborg (SE); Paul Dudfield Nurthen, East Peckham Tonbridge (GB)

(73) Assignee: Hoganas AB (Publ), Hoganas (SE)

( * ) Notice: Subject to any disclaimer, the term of this patent is extended or adjusted under 35 U.S.C. 154(b) by 590 days.

This patent is subject to a terminal disclaimer.

(21) Appl. No.: 12/440,256

(22) PCT Filed: Sep. 20, 2007

(86) PCT No.: PCT/EP2007/008190

§ 371 (c)(1),
(2), (4) Date: Apr. 28, 2009

(87) PCT Pub. No.: WO2008/034614

PCT Pub. Date: Mar. 27, 2008

(65) Prior Publication Data

US 2009/0252639 A1 Oct. 8, 2009

Related U.S. Application Data

(60) Provisional application No. 60/847,640, filed on Sep. 28, 2006.

(30) Foreign Application Priority Data

Sep. 22, 2006 (SE) ..... 0602005

(51) Int. Cl.
*B22F 1/00* (2006.01)
*C22C 33/02* (2006.01)
*C22C 29/06* (2006.01)

(52) U.S. Cl. ..... 75/240; 75/246; 148/513

(58) Field of Classification Search ..... 75/236, 75/240, 246, 255, 252; 148/513; 420/67, 420/69

See application file for complete search history.

(56) References Cited

U.S. PATENT DOCUMENTS 5,856,625 A * 1/1999 Saunders et al. ..... 75/236
6,342,087 B1 * 1/2002 Arvidsson et al. ..... 75/255
6,679,932 B2 1/2004 Birler et al.

FOREIGN PATENT DOCUMENTS

WO WO 03/069004 A1 8/2003
WO WO 2006/004529 A1 1/2006

OTHER PUBLICATIONS

Form PCT/ISA/210 for corresponding application PCT/EP2007/008190, dated Dec. 12, 2007.
Form PCT/ISA/237 for corresponding application PCT/EP2007/008190, dated Dec. 12, 2007.
Form PCT/IPEA/409 for corresponding application PCT/EP2007/008190, dated Nov. 18, 2008.

* cited by examiner

*Primary Examiner* — George Wyszomierski
*Assistant Examiner* — Mark L Shevin
(74) *Attorney, Agent, or Firm* — Buchanan Ingersoll & Rooney

(57) ABSTRACT

An annealed prealloyed water atomised iron-based powder is provided which is suitable for the production of pressed and sintered components having high wear resistance. The iron-based powder comprises 15-30% by weight of Cr, 0.5-5% by weight of each of at least one of Mo, W and V, and 0.5-2%, preferably 0.7-2% and most preferably 1-2% by weight of C. The powder has a matrix comprising less than 10% by weight of Cr, and comprises large chromium carbides. A method for production of the iron-based powder also is provided.

18 Claims, 1 Drawing Sheet

METALLURGICAL POWDER COMPOSITION AND METHOD OF PRODUCTION

FIELD OF THE INVENTION

The present invention relates to an iron-based powder. Especially the invention concerns a powder suitable for the production of wear-resistant products.

BACKGROUND ART

Products having high wear-resistance are extensively used and there is a constant need for less expensive products having the same or better performance as/than existing products.

The manufacture of products having high wear-resistance may be based on e.g. powders, such as iron or iron-based powders, including carbon in the form of carbides.

Generally, carbides are very hard and have high melting points, characteristics which give them a high wear resistance in many applications. This wear resistance often makes carbides desirable as components in steels, e.g. high speed steels (HSS), that require a high wear resistance, such as steels for drills, lathes, valve seats, and the likes.

Examples of conventional iron-based powders with high wear resistance are disclosed in e.g. the U.S. Pat. No. 6,679,932, relating to a powder mixture including a tool steel powder with finely dispersed carbides, and the U.S. Pat. No. 5,856,625 relating to a stainless steel powder.

W, V, Mo, Ti and Nb are strong carbide forming elements which make these elements especially interesting for the production of wear resistant products. Cr is another carbide forming element. Most of these conventional carbide forming metals are, however, expensive and result in an inconveniently high priced product. Thus, there is a need within the powder metallurgical industry for a less expensive iron-based powder, or high speed steel, giving sufficient wear resistance to pressed and sintered products such as for valve seats or the like.

As chromium is a much cheaper and more readily available carbide forming metal than other such metals used in conventional powders and hard phases with high wear resistance, it would be desirable to be able to use chromium as principal carbide forming metal. In that way the powder, and thus the compacted product, can be more inexpensively produced.

The carbides of regular high speed steels are usually quite small, but in accordance with the present invention it has now unexpectedly been shown that powders having equally advantageous wear resistance, for e.g. valve seat applications, may be obtained with chromium as the principal carbide forming metal, provided that the carbides are large enough.

SUMMARY OF THE INVENTION

An objective of the present invention is thus to provide an inexpensive iron-based powder for the manufacture of powder metallurgical products having a high wear resistance.

This objective, as well as other objectives evident from the discussion below, are according to the present invention achieved through an annealed pre-alloyed water atomised iron-based powder, comprising 15-30% by weight of Cr, 0.5-5% by weight of each of at least one of Mo, W, and V, and 0.5-2%, preferably 0.7-2% and most preferably 1-2% by weight of C, wherein the iron-based powder has a matrix comprising less than 10% by weight of Cr, and wherein the iron-based powder comprises large chromium carbides.

Even though a content of Cr in the range 15-30% by weight was found to result in sufficient amounts of carbides of suitable type, size and hardness, it was found that a content of Cr of 18% by weight or above further enhances this effect and results in a particularly high amount of carbides of a suitable type, size and hardness. Accordingly, in some embodiments the annealed pre-alloyed water atomised iron-based powder comprises 18-30% by weight of Cr.

In some embodiments, the annealed pre-alloyed water atomised iron-based powder comprises 15-30% by weight of Cr, 0.5-5% by weight of Mo and 1-2% by weight of C.

In accordance with the present invention this new powder which achieves the above objectives may be obtained through a method of producing an iron-based powder comprising subjecting an iron-based melt including 15-30% by weight of Cr, 0.5-5% by weight of at least one of Mo, W, and V, and 0.5-2%, preferably 0.7-2% and most preferably_1-2% by weight of C to water atomisation in order to obtain iron-based powder particles, and annealing the powder particles at a temperature, and for a period of time, sufficient for obtaining large carbides within the particles.

In preferred embodiments, it has been found that temperatures in the range of 900-1100° C. and annealing times in the range of 15-72 hours are sufficient for obtaining the desired carbides within the particles.

In some embodiments the iron-based melt comprises 18-30% by weight of Cr.

In some embodiments, the iron-based melt comprises 15-30% by weight of Cr, 0.5-5% by weight of Mo and 1-2% by weight of C.

DETAILED DESCRIPTION OF PREFERRED EMBODIMENTS

Figure 1:
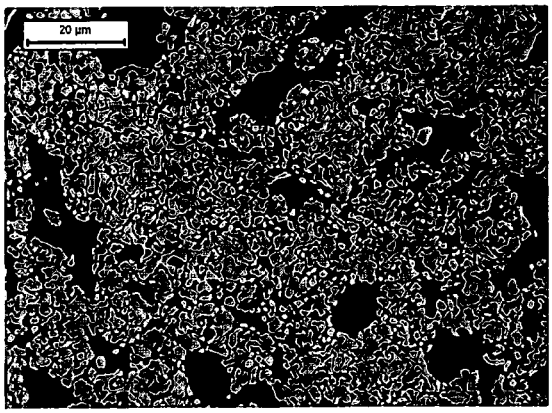
FIG. 1 shows the microstructure of A3 based test material.

The pre-alloyed powder of the invention contains chromium, 15-30%, preferably 18-25%, by weight, at least one of molybdenum, tungsten, and vanadium, 0.5-5% by weight of each, and carbon, 0.5-2%, preferably 0.7-2% and most preferably_1-2% by weight, the balance being iron, optional other alloying elements and inevitable impurities.

The pre-alloyed powder may optionally include other alloying elements, such as tungsten, up to 3% by weight, vanadium up to 3% by weight, and silicon, up to 2% by weight. Other alloying elements or additives may also optionally be included. In one embodiment, the pre-alloyed powder includes silicon, up to 2% by weight.

It should specifically be noted that the very expensive carbide forming metals niobium and titanium are not needed in the powder of the present invention.

The pre-alloyed powder preferably has an average particle size in the range of 40-100 μm, preferably of about 80 μm.

In preferred embodiments the pre-alloyed powder consists of 20-25 wt % of Cr, 1-2 wt % of Mo, 1-2 wt % of W, 0.5-1.5 wt % of V, 0.2-1 wt % of Si, 1-2 wt % of C and balance Fe, or of 20-25 wt % of Cr, 2-4 wt % of Mo, 1-2 wt % of C and balance Fe.

In other preferred embodiments the pre-alloyed powder consists of 19-23 wt % of Cr, 1-2 wt % of Mo, 1.5-3.5 wt % of W, 0.5-1.5 wt % of V, 0.2-1 wt % of Si, 1-2 wt % of C and balance Fe, or of 20-25 wt % of Cr, 2-4 wt % of Mo, 1-2 wt % of C and balance Fe.

The carbides of the inventive powder preferably have an average size in the range of 8-45 μm, more preferably in the range of 8-30 μm, and preferably make up 20-40% by volume of the total powder.

As the carbides have an irregular shape, by "size" is intended the longest extension as measured in a microscope.

Even though other types of large carbides are suitable, in some embodiments the large carbides of the inventive powder are of $M_{23}C_6$-type (M=Cr, Fe, Mo, W,), i.e. besides Cr as the dominating carbide forming element one or more of Fe, Mo and W may be present. The large carbides may also contain other than the above specified carbide forming elements in small amounts.

In order to obtain these large carbides, the pre-alloyed powder is subjected to prolonged annealing, preferably under vacuum. The annealing is preferably performed in the range of 900-1100° C., most preferably at about 1000° C., at which temperature chromium of the pre-alloyed powder reacts with carbon to form chromium carbides.

During the annealing, new carbides are formed and grow and existing carbides continue to grow through reaction between chromium and carbon. The annealing is preferably continued for 15-72 hours, more preferably for more than 48 hours, in order to obtain carbides of desired size. The longer the duration of the annealing, the larger the carbide grains grow. However, the annealing consumes lots of energy and might be a production flow bottle neck if it continues for a long time. Thus, although an average carbide grain size of about 20-30 μm may be optimal, it might, depending on priority, be more convenient from an economic point of view to terminate the annealing earlier, when the average carbide grain size is about 10 μm.

Very slow cooling, preferably more than 12 hours, from annealing temperature is applied. Slow cooling will allow further growth of carbides, as a larger amount of carbides is thermodynamically stable at lower temperatures. Slow cooling will also assure that the matrix becomes ferritic, which is important for the compressibility of the powder.

Annealing the powder also has other advantages besides the growth of carbides.

During annealing also the matrix grains grow and the inherent stresses of the powder particles, obtained as a result of the water atomisation, are relaxed. These factors make the powder less hard and easier to compact, e.g. gives the powder higher compressibility.

During annealing, the carbon and oxygen contents of the powder may be adjusted. It is usually desirable to keep the oxygen content low. During annealing carbon is reacted with oxygen to form gaseous carbon oxide, which reduces the oxygen content of the powder. If there is not enough carbon in the pre-alloyed powder itself, for both forming carbides and reducing the oxygen content, additional carbon, in form of graphite powder, may be provided for the annealing.

As much of the chromium of the pre-alloyed powder migrates from the matrix to the carbides during annealing, the matrix of the resulting annealed powder has a content of dissolved chromium of less than 10% by weight of the matrix, preferably less than 9% by weight and most preferably less than 8% by weight, why the powder is not stainless.

The matrix composition of the powder is designed such that ferrite transforms to austenite during sintering. Thereby, the austenite can transform into martensite upon cooling after sintering. Large carbides in a martensitic matrix will give good wear resistance of the pressed and sintered component.

Although the main part of the carbides of the inventive powder are chromium carbides, some carbides may also be formed by other carbide forming compounds in the pre-alloyed powder, such as the above mentioned molybdenum, tungsten and vanadium.

The annealed powder of the invention may be mixed with other powder components, such as other iron-based powders, graphite, evaporative lubricants, solid lubricants, machinability enhancing agents etc, before compaction and sintering to produce a product with high wear resistance. One may e.g. mix the inventive powder with pure iron powder and graphite powder, or with a stainless steel powder. A lubricant, such as a wax, stearate, metal soap or the like, which facilitates the compaction and then evaporates during sintering, may be added, as well as a solid lubricant, such as MnS, $CaF_2$, $MoS_2$, which reduces friction during use of the sintered product and which also may enhance the machinability of the same. Also other machinability enhancing agents may be added, as well as other conventional additives of the powder metallurgical field.

EXAMPLE 1

A melt of 21.5 wt % Cr, 1.5 wt % Mo, 1.5 wt % W, 1 wt % V, 0.5 wt % Si, 1.5 wt % C and balance Fe was water atomised to form a pre-alloyed powder. The obtained powder was subsequently vacuum annealed at 1000° C. for about 48 hours, the total annealing time being about 60 hours, after which the powder particles contained about 30% by volume of chromium carbides of an average grain size of about 10 μm in a ferritic matrix.

EXAMPLE 2

A melt of 21.5 wt % Cr, 3 wt % Mo, 1.5 wt % C and balance Fe was water atomised to form a pre-alloyed powder. The obtained powder was subsequently vacuum annealed at 1000° C. for about 48 hours, the total annealing time being about 60 hours, after which the powder particles contained about 30% by volume of chromium carbides of an average grain size of about 10 μm in a ferritic matrix.

EXAMPLE 3

A melt of 21.0 wt % Cr, 1.5 wt % Mo, 2.5 wt % W, 1 wt % V, 0.5 wt % Si, 1.6 wt % C and balance Fe was water atomised to form a pre-alloyed powder. The obtained powder was subsequently vacuum annealed at 1000° C. for about 48 hours, the total annealing time being about 60 hours, after which the powder particles contained about 30% by volume of chromium carbides of an average grain size of about 10 μm in a ferritic matrix.

The obtained powder (hereafter referred to as A3) was mixed with 0.5 wt % graphite and 0.75 wt % of an evaporative lubricant. The mix was compacted into test bars at a pressure of 700 MPa. The obtained samples were sintered in an atmosphere of $90N_2/10H_2$ at a temperature of 1120° C. After sintering the samples were subjected to cryogenic cooling in liquid nitrogen followed by tempering at 550° C.

A similar mix based on the known HSS powder M3/2, was prepared and test bars were produced using the same process as the one described above.

The test bars were subjected to hardness tests according to the Vickers method. Hot hardness was tested at three different temperatures (300/400/500° C.). The results are summarised in the table below.

| Powder in mix | Porosity (%) | HV0.025 | HV5 | Hot hardness (HV5) 300° C. | 400° C. | 500° C. |
|---|---|---|---|---|---|---|
| A3 | 23 | 825 | 356 | 286 | 256 | 268 |
| M3/2 | 17 | 836 | 415 | 363 | 326 | 267 |

The microstructure of the A3 test material (see FIG. 1) consists of many large carbides in a martensitic matrix, while the reference material has a microstructure (see FIG. 2) with considerably smaller carbides in a martensitic matrix.

The A3 material has somewhat higher porosity than the M3/2 material, which explains why the A3 hardness values (HV5) are lower than those for M3/2 although the microhardness values (HV0.025) for the two materials are nearly the same. In the production of PM VSI components, the porosity is normally eliminated by copper infiltration during sintering and such effects can therefore be neglected. In the light of this, the hardness values of the A3 material are comparable to those of the reference M3/2 material, which gives good indication that the materials should have comparable wear resistance. Especially, maintaining hardness at elevated temperatures is important for wear resistance in VSI applications. The hot hardness test results show that the A3 material meets these requirements.

EXAMPLE 4

A melt of 21.5 wt % Cr, 3 wt % Mo, 1.5 wt % C and balance Fe was water atomised to form a pre-alloyed powder. The obtained powder was subsequently vacuum annealed at 1000° C. for about 48 hours, the total annealing time being about 60 hours, after which the powder particles contained about 30% by volume of chromium carbides of an average grain size of about 10 μm in a ferritic matrix.

Figure 2:
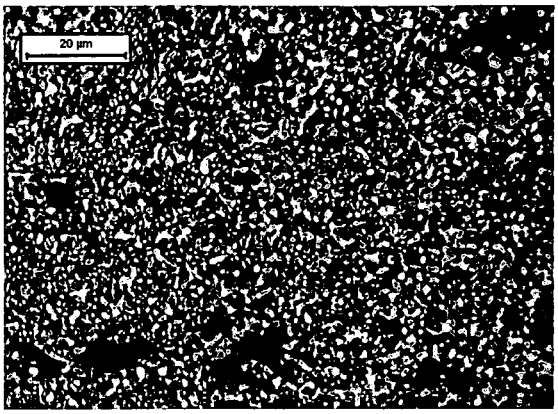
FIG. 2 shows the microstructure of M3/2 based test material.

Processing this powder, mixed with 0.5 wt % graphite and 0.75 wt % of an evaporative lubricant, to produce test bars in the same way as in example 3, resulted in a microstructure very similar to that in FIG. 1.

The invention claimed is:

1. An annealed pre-alloyed water atomised, iron-based powder, comprising:

15-30% by weight of Cr;

0.5-5% by weight of each of at least one of Mo, W, and V; and 0.5-2% by weight of C;

the balance being iron, and optionally silicon up to 2% by weight, and inevitable impurities;

wherein the iron-based powder has a matrix comprising less than 10% by weight of Cr and comprises chromium carbides having an average size of 8-45 μm.

2. An iron-based powder according to claim 1, comprising 18-25% by weight of Cr.

3. The annealed prealloyed water atomised, iron-based powder according to claim 2, including carbides having an average size of 8-30 μm.

4. An iron-based powder according to claim 1, comprising 15-30% by weight of Cr;

0.5-5% by weight of Mo; and 1-2% by weight of C.

5. An iron-based powder according to claim 1, including carbides having an average size of 8-30 μm.

6. An iron-based powder according to claim 1, comprising 20-40% by volume of carbides.

7. An iron-based powder according to claim 1, wherein the matrix is not stainless.

8. An iron-based powder according to claim 1, having a weight average particle size of 40-100 μm.

9. An iron-based powder according to claim 1, consisting of 20-25 wt % of Cr, 1-2 wt % of Mo, 1-2 wt % of W, 0.5-1.5 wt % of V, 0.2-1 wt % of Si, 1-2 wt % of C, and balance Fe.

10. An iron-based powder according to claim 1, consisting of 19-23 wt % of Cr, 1-2 wt % of Mo, 1.5-3.5 wt % of W, 0.5-1.5 wt % of V, 0.2-1 wt % of Si, 1-2 wt % of C, and balance Fe.

11. An iron-based powder according to claim 1, consisting of 20-25 wt % of Cr, 2-4 wt % of Mo, 1-2 wt % of C, and balance Fe.

12. The annealed prealloyed water atomised, iron-based powder according to claim 1, wherein 0.7-2% C is present.

13. The annealed prealloyed water atomised, iron-based powder according to claim 1, wherein 1-2% C is present.

14. A method of producing an iron-based powder comprising:

subjecting an iron-based melt including 15-30% by weight of Cr, 0.5-5% by weight of each of at least one of Mo, W, and V, 0.5-2% by weight of C, and balanced with iron, and optionally silicon up to 2% by weight, and inevitable impurities, to water atomisation in order to obtain iron-based powder particles; and annealing the powder particles at a temperature, and for a period of time, sufficient for obtaining a matrix comprising less than 10% by weight of Cr, and obtaining chromium carbides having an average size of 8-45 μm.

15. A method according to claim 14, wherein the iron-based melt includes 18-25% by weight of Cr.

16. A method according to claim 14, wherein the iron-based melt includes 15-30% by weight of Cr;

0.5-5% by weight of Mo; and 1-2% by weight of C.

17. The method for producing an iron-based powder according to claim 14, wherein said iron-based melt includes 0.7-2% by weight of C.

18. The method for producing an iron-based powder according to claim 14, wherein said iron-based melt includes 1-2% by weight of C.

* * * * *